US011564521B1

(12) United States Patent
Perrelli et al.

(10) Patent No.: US 11,564,521 B1
(45) Date of Patent: Jan. 31, 2023

(54) ACCESS DEVICES AND METHODS OF USING AND MAKING THE SAME

(71) Applicant: Seven Siblings LLC, Great Falls, VA (US)

(72) Inventors: Kara Perrelli, Great Falls, VA (US); Marc Perrelli, Great Falls, VA (US)

( * ) Notice: Subject to any disclaimer, the term of this patent is extended or adjusted under 35 U.S.C. 154(b) by 58 days.

(21) Appl. No.: 16/679,134

(22) Filed: Nov. 8, 2019

Related U.S. Application Data

(60) Provisional application No. 62/758,491, filed on Nov. 9, 2018.

(51) Int. Cl.
*A47G 29/00* (2006.01)
*A47G 29/08* (2006.01)
*A47D 15/00* (2006.01)

(52) U.S. Cl.
CPC ..... *A47G 29/08* (2013.01); *A47D 15/00* (2013.01)

(58) Field of Classification Search
None
See application file for complete search history.

(56) References Cited

U.S. PATENT DOCUMENTS 4,706,914 A * 11/1987 Ground ..... F16B 2/08 248/74.3
4,759,963 A * 7/1988 Uso, Jr. ..... A01K 97/08 224/901.4
4,862,563 A * 9/1989 Flynn ..... A44B 18/00 24/442
4,934,646 A * 6/1990 Doyle ..... A47F 5/0006 248/205.2
5,535,928 A * 7/1996 Herring ..... A45F 5/021 224/250
5,651,485 A * 7/1997 Impastato, II ..... B62J 11/00 224/460
5,941,434 A * 8/1999 Green ..... A47G 23/0225 224/250
7,284,730 B2 * 10/2007 Walsh ..... A61M 25/02 128/877

* cited by examiner

*Primary Examiner* — Steven M Marsh
(74) *Attorney, Agent, or Firm* — Kenealy Vaidya LLP

(57) ABSTRACT

Access devices for removably retaining an object are provided, as well as methods of making and using such access devices. The access device can include: a device body including a back side and a front side; an anchor device secured on the back side of the device body, and the anchor device for securing the access device to a supporting structure; and a retention device secured on the front side of the device body, and the retention device for removably retaining the object.

15 Claims, 11 Drawing Sheets

100 access device front side 116
140 first retention device
mechanical fastener 115
(e.g. thread)
120 first anchor device
(e.g. cloth tie)
150 second retention device
110 device body
163
3
3
(see Fig. 3)
164
first fastener 162
165
strap 161
130 second anchor device
160 third retention device

ACCESS DEVICES AND METHODS OF USING AND MAKING THE SAME

RELATED APPLICATION AND PRIORITY

This application claims priority to U.S. Provisional Patent Application 62/758,491 filed Nov. 9, 2018, the content of which is incorporated herein by reference in its entirety.

BACKGROUND

The disclosure relates to devices for retaining an object, so as to provide ready and convenient access to the object.

Various devices have been used in the past to provide access to an item or items. More specifically, various devices are known to retain or hold an item in a stowed position for access when the item is desired. Known devices vary in the particular manner in which an item is retained on the device. In some known devices, an item is simply placed upon the device. In other known devices, an item is secured to the device in some manner. In yet further devices, an item is enclosed within the device. However, known devices and arrangements have deficiencies.

The embodiments of the disclosure address these and other deficiencies in known technology.

BRIEF SUMMARY

Access devices for removably retaining an object are provided, as well as methods of making and using such access devices. The access device can include: a device body including a back side and a front side; an anchor device secured on the back side of the device body, and the anchor device for securing the access device to a supporting structure; and a retention device secured on the front side of the device body, and the retention device for removably retaining the object.

BRIEF DESCRIPTION OF THE DRAWINGS

The present disclosure can be more fully understood by reading the following detailed description together with the accompanying drawings, in which like reference indicators are used to designate like or similar elements, and in which.

DETAILED DESCRIPTION OF THE DISCLOSURE

Figure 1:
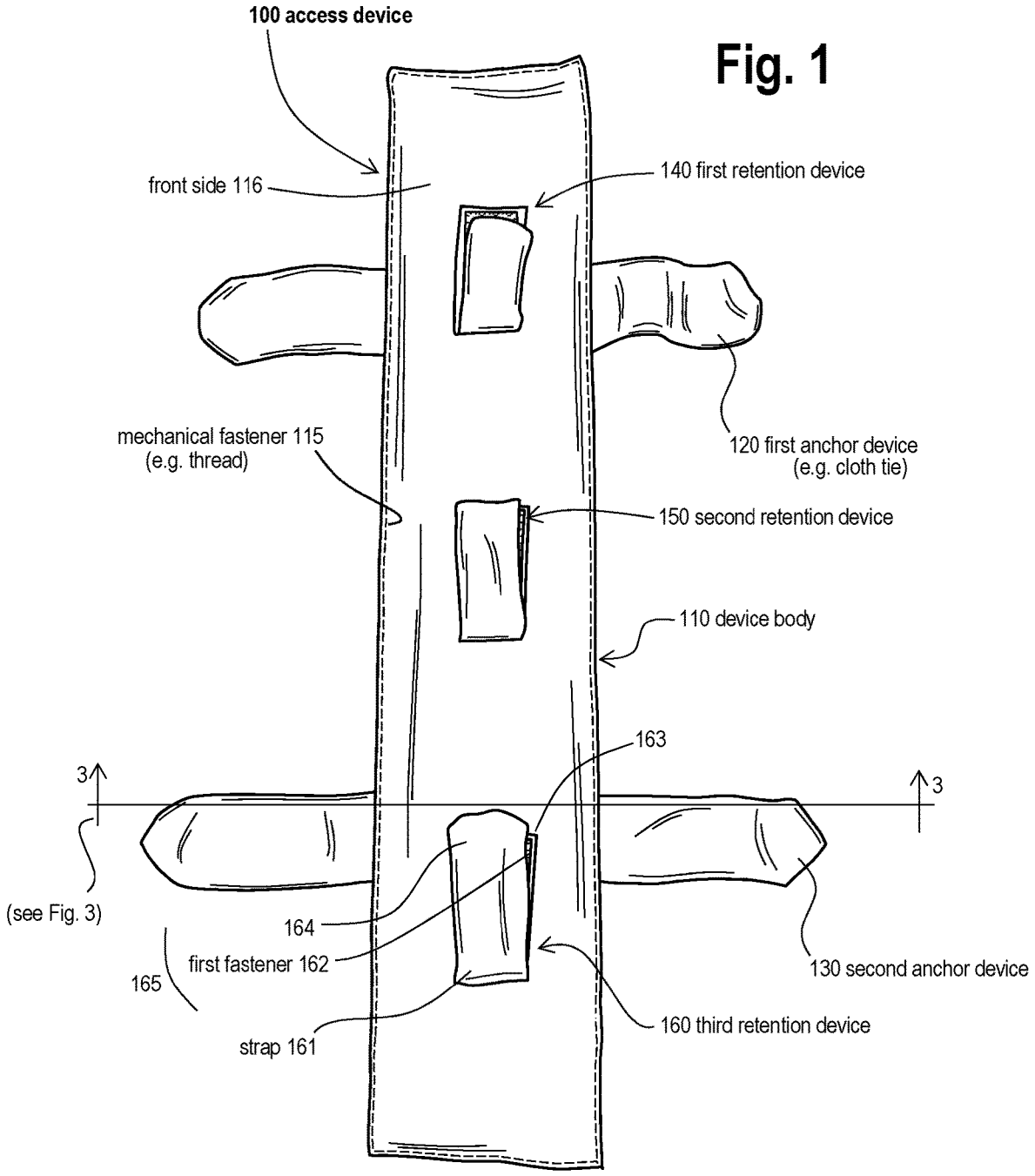
FIG. 1 is a front view of an access device, in accordance with at least one embodiment of the disclosure.

Hereinafter, aspects of the disclosure in accordance with various embodiments will be described. As used herein absent context to the contrary, any term in the singular may be interpreted to be in the plural, and alternatively, any term in the plural may be interpreted to be in the singular.

The disclosure provides access devices and methods of making and using the same. An access device is provided that can hold multiple objects for infants and toddlers, for example. The objects can include teething rings, pacifiers, and small toys, as well as a wide variety of other objects. In conjunction with holding such objects, the access device can be securely and safely attached to a solid object, i.e. a supporting structure. The solid object could be a crib, other piece of furniture, or an infant car seat, for example. The access device allows easy and convenient access for various objects that are frequently misplaced and desired by an infant or toddler, as well as an adult watching over the infant or toddler.

The "access device" lends its name to easy "access" that the device provides to an infant, toddler or adult, or other person. The access device might also be characterized as a multi-access device in that the access device can retain a plurality of objects at the same time. The access device might also be characterized as a "holder device".

The access device of the disclosure can attach to a solid object using what is herein characterized as an anchor device. The access device can include one or more anchor devices. The anchor device can be in the form of hook and loop fasteners (Velcro), magnets, snaps, or tie enclosures, for example. Such anchor devices can afford easy attachment and removal, for an adult, of the access device from the solid object to which the access device can be attached. The anchor device is attached to what can be characterized as a "backside" of the access device. The backside might also be characterized as an attachment side.

The access device can include a device body, which includes the backside as well as a front side of the device body. The front side of the device body might also be characterized as the "face" of the device body. The front side of the device body, of the access device, can include a plurality of retention devices. It is the retention device(s), on the front side, that functions to hold an object or objects for the infant or toddler. Each of the retention devices can be in the form of a smaller, i.e. smaller than the anchor device on the backside, retention strap, for example. Each of the retention devices can attach to an object, such as a pacifier, in a convenient and easily accessed manner.

The access device can be constructed so as to make it safe, firm, and functional for securely attaching to a solid object and for attaching smaller objects to the front face of the access device.

The device body of the access device can be constructed of a single piece of fabric. As described further below, the device body can be reinforced or stiffened with internal structure, such as an internal insert constructed of metal, plastic, or wood, for example. The access device, as constructed, can vary in size and geometry depending on a variety of factors including a particular environment of intended use, the particular "solid object" to which the access device will be attached or is intended to be attached, the particular objects that the access device is envisioned to retain and/or other factors. Illustratively, the access device can measure approximately 7 to 11 inches in length and 2 to 3 inches wide. However, dimensions of an access device of the disclosure can vary. The access device can have multiple straps on the front side, which respectively provide the retention devices. The access device can have multiple straps on the backside or rear side, which respectively provide the anchor devices. As noted above, the anchor devices can be stronger than the retention devices so that an object (retained by the retention device) can be removed by "pulling force" before such pulling force removes the access device from the solid object. Indeed, an aspect of the invention is the relationship between the "pulling force" required to remove the object from the access device vis-à-vis the "pulling force" required to remove the access device from the solid object.

Accordingly, the front (or face) of the access device can include a plurality of smaller retention devices, which can be in the form of straps, specifically designed to hold small objects, such as pacifiers, teething rings and small toys, while being easy to remove those objects for both adults and small children alike.

The back (or attachment side) of the access device can include a plurality of larger anchor devices, i.e. larger than the retention devices, that are specifically designed to affix the access device securely to the solid object. As described above, the solid object, i.e. the supporting structure, can be a larger object such as a crib or other piece of furniture. Accordingly, the anchor device or anchor devices provide functionality to remain securely attached to the solid object, while objects are affixed and removed from the front side (or face) of the access device. The access device can be positioned in a same position in a crib, for example, so that the infant learns where the access device is located. As a result, the infant can learn (and be assured) where device(s) can be conveniently and easily located. Such can provide a component of mental well being to the infant, or other person.

Hereinafter, further details of the access device of the disclosure will be described with reference to the figures.

FIG. 1 is a front view of an access device 100, in accordance with at least one embodiment of the disclosure. As described above, the access device might also be characterized as a holder device.

The access device 100 can include a device body 110. The device body 110, as shown in FIG. 1, can be elongated in structure having a length and a width. Illustratively, the device body 110 might be sized to fit upon a spindle of a crib, on the side of the crib, or in the corner of a crib, for example. A plurality of anchor devices can be attached to a backside 117 of the device body (see FIG. 2). Specifically, a first anchor 120 can be attached to the backside 117 and the second anchor 130 can be attached to the backside 117. The first and second anchor devices 120, 130 can be in the form of a cloth tie or a strap with Velcro, for example. However, other structures can be used for the anchor device as described below.

The access device 100 can also include a plurality of retention devices. The retention devices can include a first retention device 140, a second retention device 150, and a third retention device 160. Each of the retention devices 140, 150, 160 can be attached to a front side 116 of the access device. Each of the retention devices 140, 150, 160 can be a strap.

Illustratively, the third retention device 160 can be in the form of a strap 161. The strap 161 can be a section of material that is "doubled over" upon itself so as to hold the object, such as a pacifier. The ends of the strap 161 can be provided with one or more fasteners 165, to hold the ends of the strap together. The fasteners 165 can include the first fastener 162, as shown in FIG. 1. More specifically, the strap 161 can include a first leg 163 and a second leg 164. The leg 163, of the strap 161, can be attached or secured to the device body 110. For example, the first leg 163 can be sewed to the device body 110. Alternatively, or in addition to sewing, first leg 163 can be adhesively attached to the device body 110. The first leg 163 can be attached using some other arrangement, mechanism, or device. Further details of the retention device are described below, in particular with reference to FIG. 5, which describes the second retention device 150, which can be of same or similar construction to the third retention device 160.

The device body 110 can be constructed of material that is safe and appealable to infants. Likewise, the various other components of the access device 100 can be constructed of material that is safe for infants. Illustratively, the device body 110 can be constructed of a cloth or "textile" material. The device body 110 can be constructed of 2 layers of cloth material. With such construction, the edges of each layer of the device body 110, as shown in FIG. 1, can be connected together utilizing a mechanical fastener 115. Illustratively, the mechanical fastener 115 might be constituted by a seam or stitching of thread that extends along a peripheral edge of the device body 110. The device body 110 can include inserts, stiffeners, or other structure so as to vary the stiffness of the device body 110 as desired. For example, an insert constructed of plastic (or other material) can be provided between layers of materials that make up the device body 110. The insert can extend or occupy extents of the device body 110 as may be desired. For example, an insert to provide stiffness can extend throughout the entirety of a space between the layers of the device body 110. On the other hand, an insert can be provided in only a portion of the device body 110, i.e., so as to stiffen only that portion. It is appreciated that additional mechanical fasteners 115 can be used so as to position or hold an insert at a desired position. Additionally, an insert used to stiffen the device body 110 need not be a consistent stiffness throughout the length of the insert. For example, the insert might be constructed of material that is thicker in a central location, of the insert, then at a peripheral location. Accordingly, stiffness at the center of the insert would be greater than stiffness along the edges of the insert.

Relatedly, it is appreciated that the device body 110 itself can be constructed of material so as to provide a degree of thickness and/or stiffness as may be desired. The device body 110 can be constructed of double or more layers of material. However, the disclosure is not limited to such structure. The device body 110 can be constructed of a single layer or more than 2 layers. The device body 110, as well as an insert provided therein, can be constructed of any of a wide variety of materials as may be desired.

Figure 2:
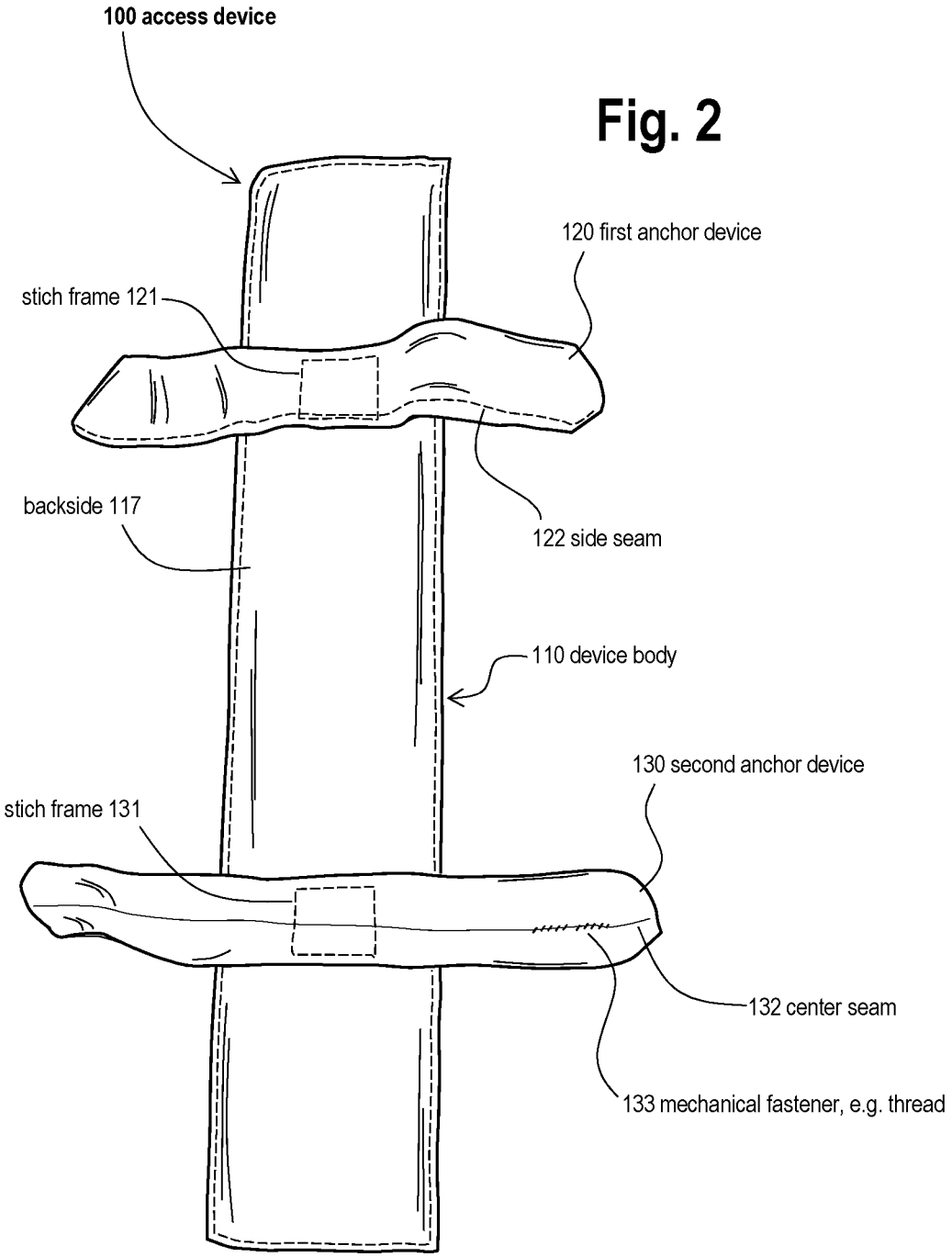
FIG. 2 is a back view of the access device of FIG. 1, or similar thereto, in accordance with at least one embodiment of the disclosure.

FIG. 2 is a back view of the access device 100 of FIG. 1, or similar thereto, in accordance with at least one embodiment of the disclosure. In the embodiment of FIG. 2, two anchor devices are attached to the backside 117 of the device body 110. The two anchor devices include the first anchor device 120 and the second anchor device 130. The particular point of attachment of the anchor devices on the backside 117 can vary depending on different considerations in the particular environment in which the access device 100 is intended to be used. It is appreciated that positioning the first anchor device 120 at the top of the access device 100, as oriented in FIG. 2, and positioning the second anchor device 130 at the bottom of the access device 100, might provide more stability, and resistance to rotation, as opposed to if the anchor devices were attached more towards the middle (in the vertical direction). However, positioning the anchor devices at or close to the top and bottom of the access device 100 might result in limited structural strength and resistance to deformation along the center of the access device 100. However, such limited structural strength can be overcome with use of an insert provided within the access device 100. Relatedly, it is appreciated that the invention is not limited to the two anchor devices 120, 130 as shown in FIG. 2. That is, three or more anchor devices might be utilized if desired. Such additional included devices can provide further resistance to rotation and can provide additional strength. On the other hand, there may be simply one anchor device to attach the access device 100 to a solid object, i.e. what might be characterized as a "supporting structure". With such construct of utilizing one anchor device, it may be beneficial to provide the one anchor device with additional height, in the orientation of FIG. 2, so as to provide greater stability and greater support against rotation. In other words, a "wider" anchor device in the vertical direction can provide a longer "torque arm" so as to sufficiently support the access device 100.

As described above, the device body 110 can be constructed of multiple layers that are connected or attached together utilizing mechanical fasteners 115, such as a threaded seam or stitching. As shown in FIG. 2, the seam extends along the entire periphery of the device body 110, in the situation that the 2 layers of the device body 110 are separate pieces of material. For example, the 2 layers of the device body 110 might be separate pieces of cloth. However, in other embodiments, the double layered device body 110 might be a single piece of material, for example cloth, that is doubled over upon itself and sewed along the three sides to be connected.

The anchor devices 120, 130 can be of similar structure to that of the device body 110. That is, the anchor devices can be constructed of cloth, or other material as may be desired, and folded or sewn so as to provide the anchor device. Illustratively, the first anchor device 120, as shown in FIG. 2, can include folded over material that is connected at the unfolded side with side seam 122. The side seam 122 can include mechanical fasteners such as thread, for example. On the other hand, the second anchor device 130 can be of different structure. Specifically, the second anchor device 130 can be constructed of a single piece of material, folded over on both the upper side and lower side as shown in FIG. 2, and with the two sides connected together at a center seam 132. A mechanical fastener 133, such as thread, might be utilized to provide the center seam 132.

The particulars of the construct of the first anchor device 120 and the second anchor device 130 are illustrative. It should be appreciated that the anchor devices can be constructed in other manners as may be desired. For example, the anchor devices 120, 130 might simply be a single piece of material, such as a single piece of cloth material.

The first anchor device 120 can be connected to the device body 110 utilizing a stitch "frame" 121. For example, the stitch frame 121 can include mechanical fasteners such as threads. The second anchor device 130 can be connected to the device body 110 in similar manner. Specifically, the second anchor device 130 can be attached to the device body 110 utilizing a stitch frame 131. Alternatively, other mechanical arrangements or devices can be utilized to attach the anchor devices to the device body 110. For example, adhesive or grommets can be utilized taking into account appropriate safety concerns.

As shown in FIG. 2, with illustrative reference to the anchor device 120, the anchor device 120 is shown as attached to the device body 110 proximate a center or middle portion of the first anchor device 120. In other words, the first anchor device 120 can be attached so that the two sides of the anchor device 120, about the stitch frame 121, are approximately equal. However, the invention is not limited to such construct. One side of the anchor device 120 can be longer than the other side of the anchor device 120. In particular, such arrangement with one side longer can be provided if the anchor device 120 is constructed of material so as to be "tied" to a supporting structure. In such scenario, it may be beneficial to make one side of the anchor device 120 longer than the other side, i.e., so as to assist in tying the anchor device to a supporting structure, such as a spindle of a crib.

Figure 3:
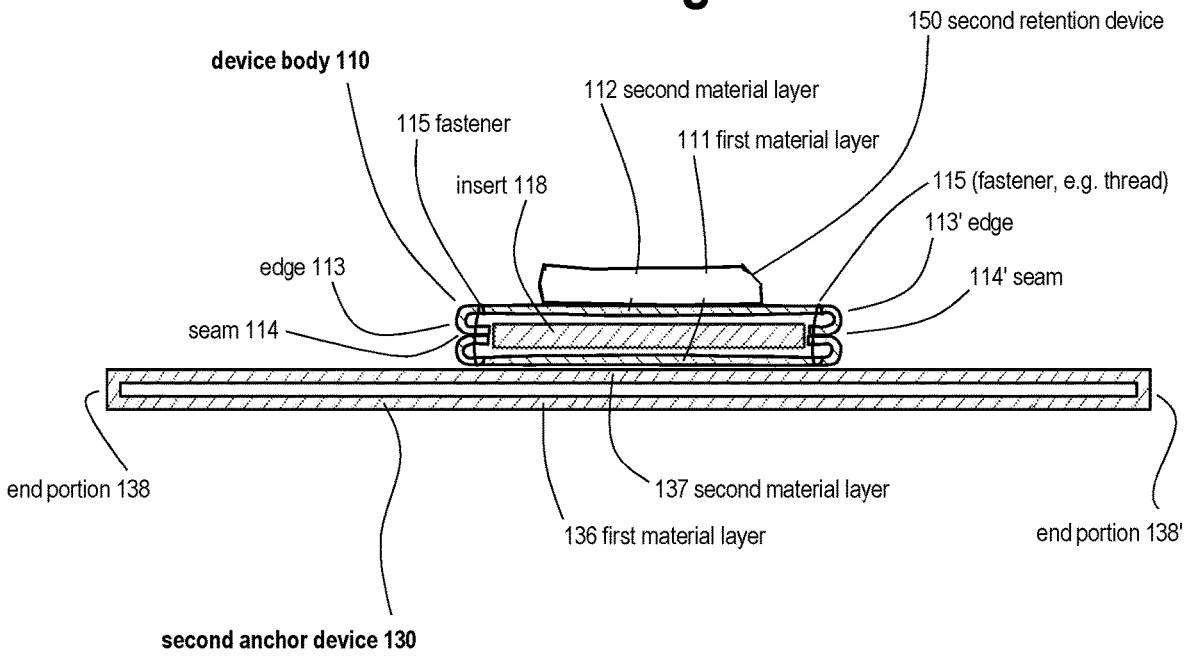
FIG. 3 is a cross-sectional view of the access device of FIG. 1, or similar thereto, along line 3-3 of FIG. 1, in accordance with at least one embodiment of the disclosure.

FIG. 3 is a cross-sectional view of the access device of FIG. 1, or similar thereto, along line 3-3 of FIG. 1, in accordance with at least one embodiment of the disclosure.

FIG. 3 shows the second anchor device 130. The anchor device 130 can include end portion 138 and end portion 138'. Additionally, the anchor device 130 can include a first material layer 136 and a second material layer 137. Seams or folds can be included in the second anchor device 130 depending on the particular construct of the second anchor device 130.

FIG. 3 also shows further details of the device body 110, in accordance with at least one embodiment of the disclosure. The device body 110 can include a first material layer 111 and a second material layer 112. The device body 110 can have edges 113, 113' that can include respective seams 114, 114'. Mechanical fasteners 115, such as thread as described above, can be used to attach the first material layer 111 to the second material layer 112. As described above, an insert 118 can be provided in an internal cavity or space between the material layers 111, 112.

Additionally, FIG. 3 shows the second retention device 150. The second retention device 150 can be attached to the second material layer 112 utilizing adhesive or stitching or some other mechanical attachment mechanism, for example.

Figure 4:
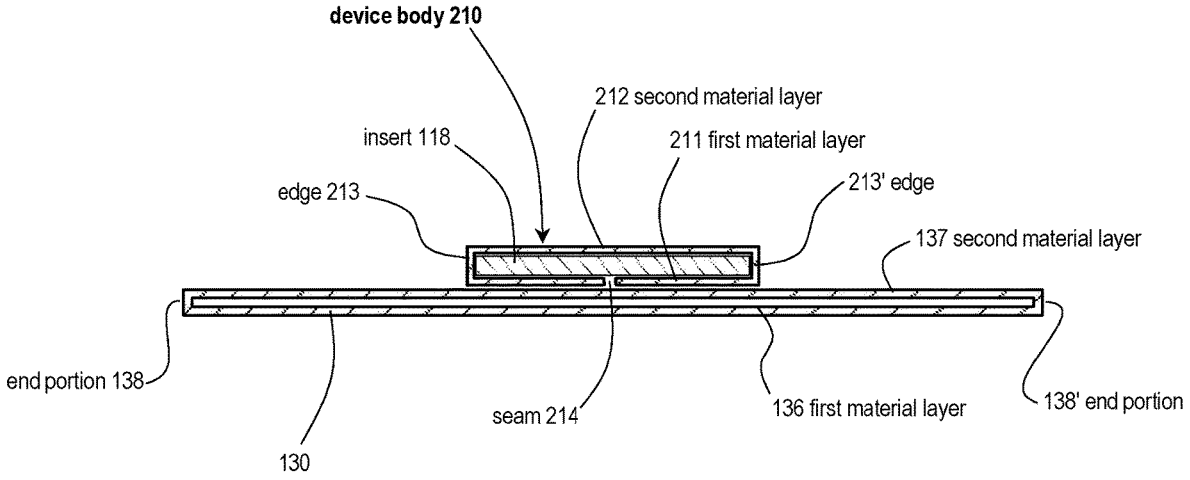
FIG. 4 is a cross-sectional view of a further access device, in accordance with at least one embodiment of the disclosure.

FIG. 4 is a cross-sectional view of a further access device, including device body 210 and second anchor device 130, in accordance with at least one embodiment of the disclosure. In the arrangement of FIG. 4, a device body 210 is provided that is different than the device body 110 of FIG. 3. In the device body 210, a seam 214 is provided so as to connect a first material layer 211 to a second material layer 212. The material layers 211, 212 can be folded at opposing edges 213, 213' rather than being stitched at such opposing edges. As shown, the device body 210 can include an insert 118. The insert can provide structural strength and/or provide desired stiffness of the device body 210, for example.

Figure 5:
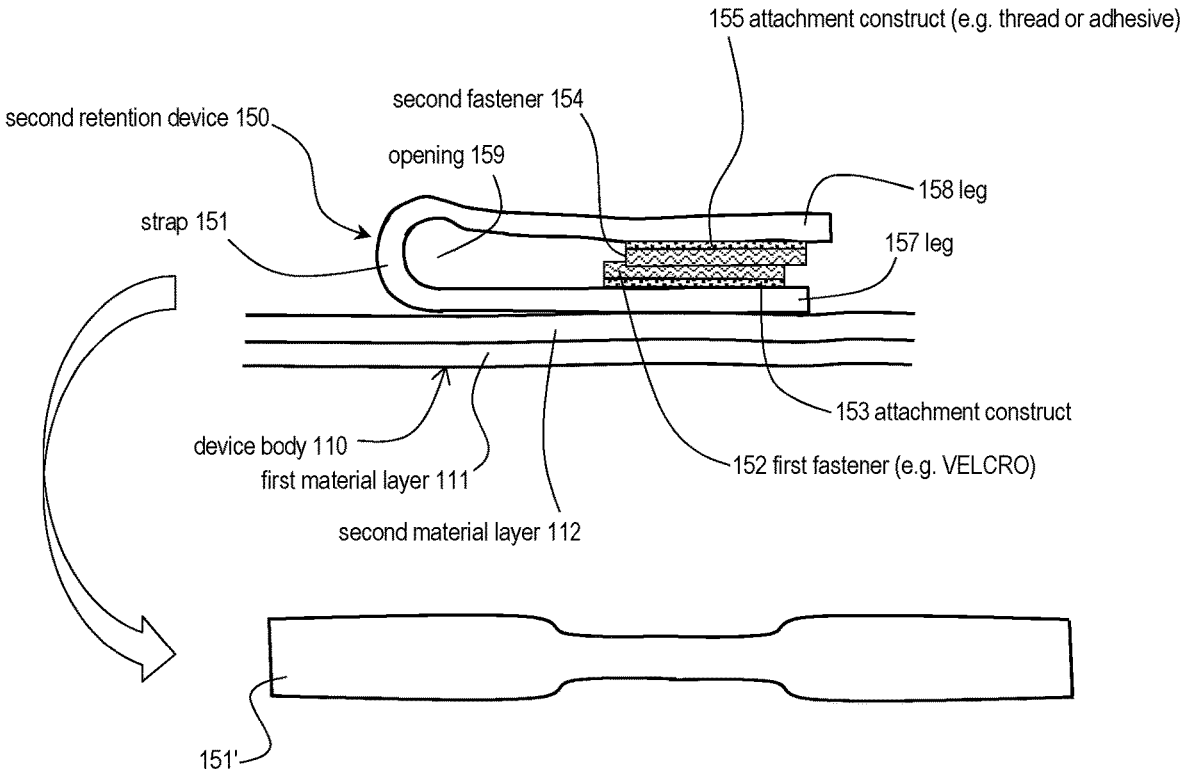
FIG. 5 is a side view of an access device with retention device in a closed position, in accordance with at least one embodiment of the disclosure.

FIG. 5 is a side view of an access device with retention device in a closed position, in accordance with at least one embodiment of the disclosure. More specifically, FIG. 5 shows second retention device 150 attached to device body 110. The device body 110 can include a first material layer 111 and a second material layer 112. The retention device 150 can be attached to the second material layer 112 using stitching or adhesive, for example. The retention device 150 can include and/or be in the form of strap 151. The retention device 150 can be folded upon itself and include leg 157 of the strap 151 and leg 158 of the strap 151. The legs 157, 158 of the strap 151 can be selectively attached or connected together—or disconnected—utilizing a first fastener 152 and a second fastener 154. Such fasteners can be in the form of Velcro, for example. The first fastener 152 can be connected to leg 157 with an attachment construct 153. Illustratively, the first fastener 152 can be a Velcro strip that is connected to the leg 157 utilizing stitching or adhesive. In other words, the stitching or adhesive constitutes the attachment construct 153. In similar manner, the second fastener 154 can be attached to leg 158, of the strap 151, utilizing an attachment construct 155.

As shown in FIG. 5, the folded over legs 157, 158 can form opening 159. The opening 159 can serve to retain or hold an object, such as a pacifier or infant toy, for example. In use, the infant toy or other object might include a ring or similar appendage that can be positioned in the opening 159. Alternatively, the body itself of a particular object can be retained in the opening 159. It should be appreciated that an object can be secured or retained by the retention device 150 in a wide variety of manners depending on the particular structure of the object, as well as the particular structure and dimensions of the retention device 150. In manufacturing, the dimensions, shape, and other attributes of the retention device 150 can be provided with certain objects in mind. For example, the retention device 150 might be constructed so as to provide a larger opening 159 then that shown in FIG. 5. Such larger opening may provide for the body of a pacifier to be held within the opening 159, whereas a smaller opening 159 might not work to hold a pacifier. The retention device can be varied in width or tapered so as to better retain an object. The retention device, such as a strap 151', can be provided with a "bottleneck" shape that is wide, then narrowed, then wide again along a length of the strap, as shown as a further embodiment in FIG. 5. Such structure may enhance connectability with some objects, depending on shape of such object to be retained.

Figure 6:
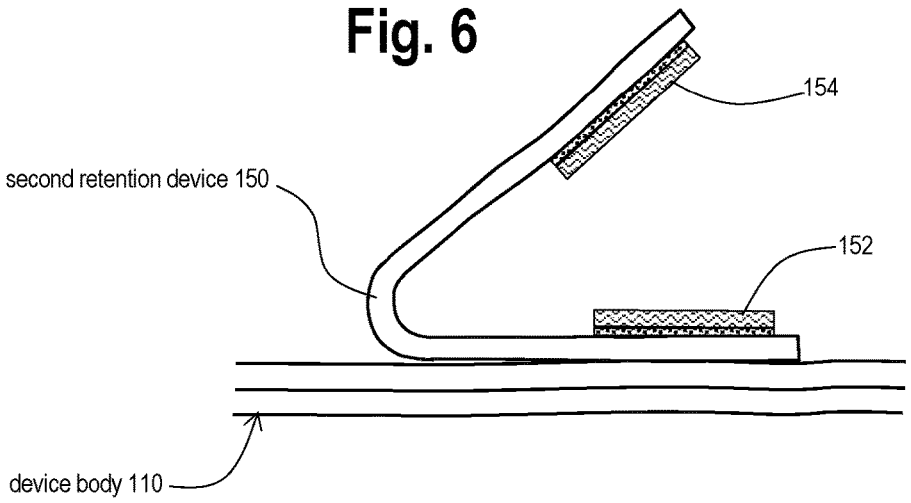
FIG. 6 is a side view of the access device of FIG. 5, with retention device in an open position, in accordance with at least one embodiment of the disclosure.

FIG. 6 is a side view of the access device of FIG. 5, with retention device in an open position, in accordance with at least one embodiment of the disclosure. As shown in FIGS. 5 and 6, the legs 157, 158 are shown as being substantially straight. However, the invention is not limited to such particular construct. Rather, the legs 157, 158 can be of various shapes as may be desired.

Figure 7:
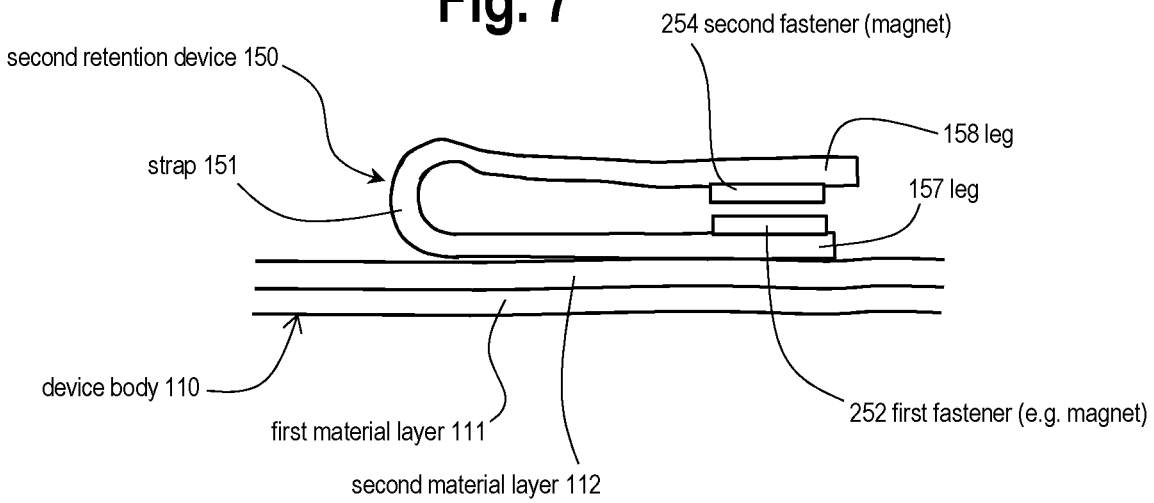
FIG. 7 is a side view of a further access device with retention device in a closed position, in accordance with at least one embodiment of the disclosure.
Figure 8:
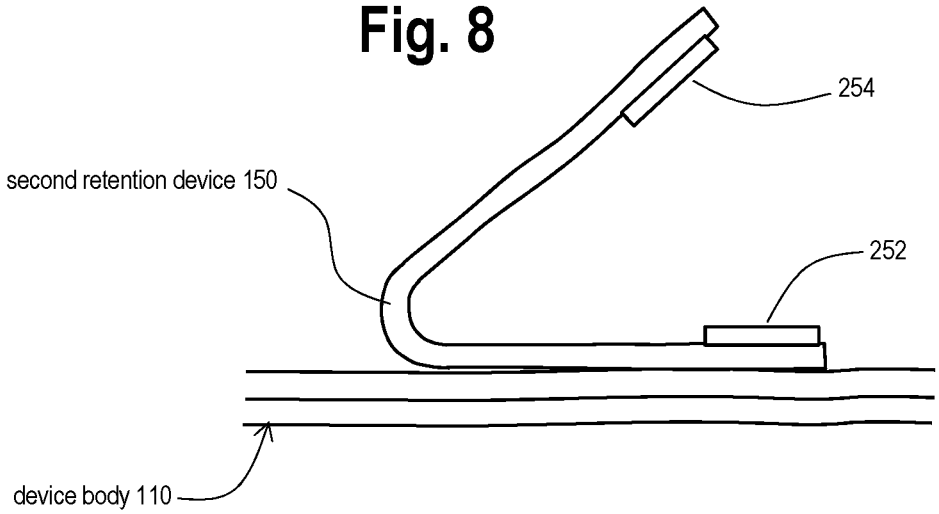
FIG. 8 is a side view of the access device of FIG. 7, with retention device in an open position, in accordance with at least one embodiment of the disclosure.

FIG. 7 is a side view of a further access device with retention device in a closed position, in accordance with at least one embodiment of the disclosure. FIG. 8 is a side view of the access device of FIG. 7, with retention device in an open position, in accordance with at least one embodiment of the disclosure. FIGS. 7 and 8 are provided to show a retention device 150 with different type of fasteners to connect the legs 157, 158 of the strap 151. As shown, the legs 157, 158, and more specifically the ends or adjacent to the ends, can be connected utilizing first fastener 252 and second fastener 254. Both the first fastener and the second fastener can be in the form of complementary magnets. The strength of the magnets, and the amount of effort to disengage the magnets from each other, can be varied so as to result in a variance of how much force is required to remove an object from the retention device 150. It is of course appreciated that a stronger magnet will require a stronger force to remove a retained object.

Various aspects and features of the second retention device 150 have been described above. The other retention devices 140, 150, for example, can be provided with similar aspects and features.

Figure 9:
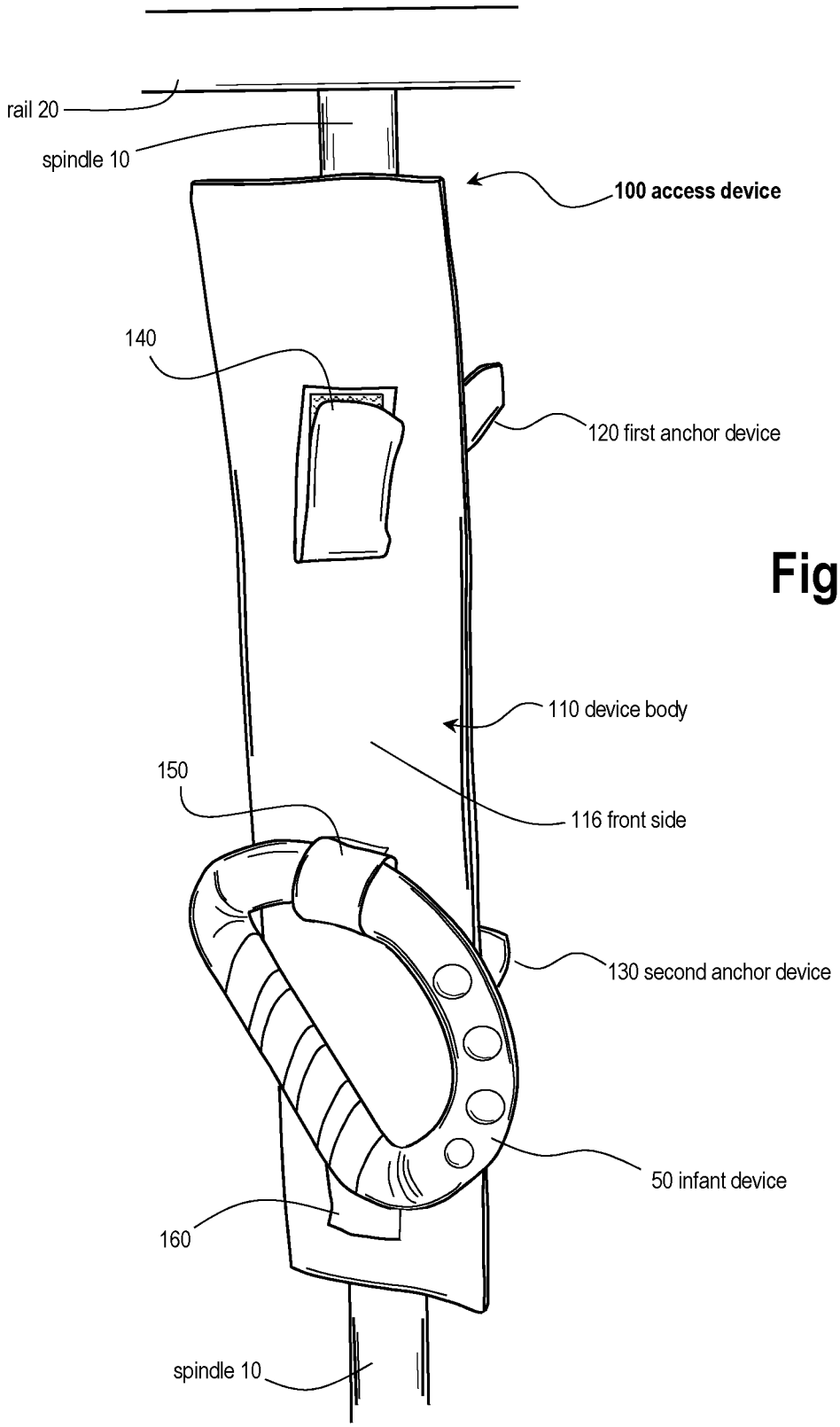
FIG. 9 is a front view perspective view showing an access device with object attached, in accordance with at least one embodiment of the disclosure.
Figure 10:
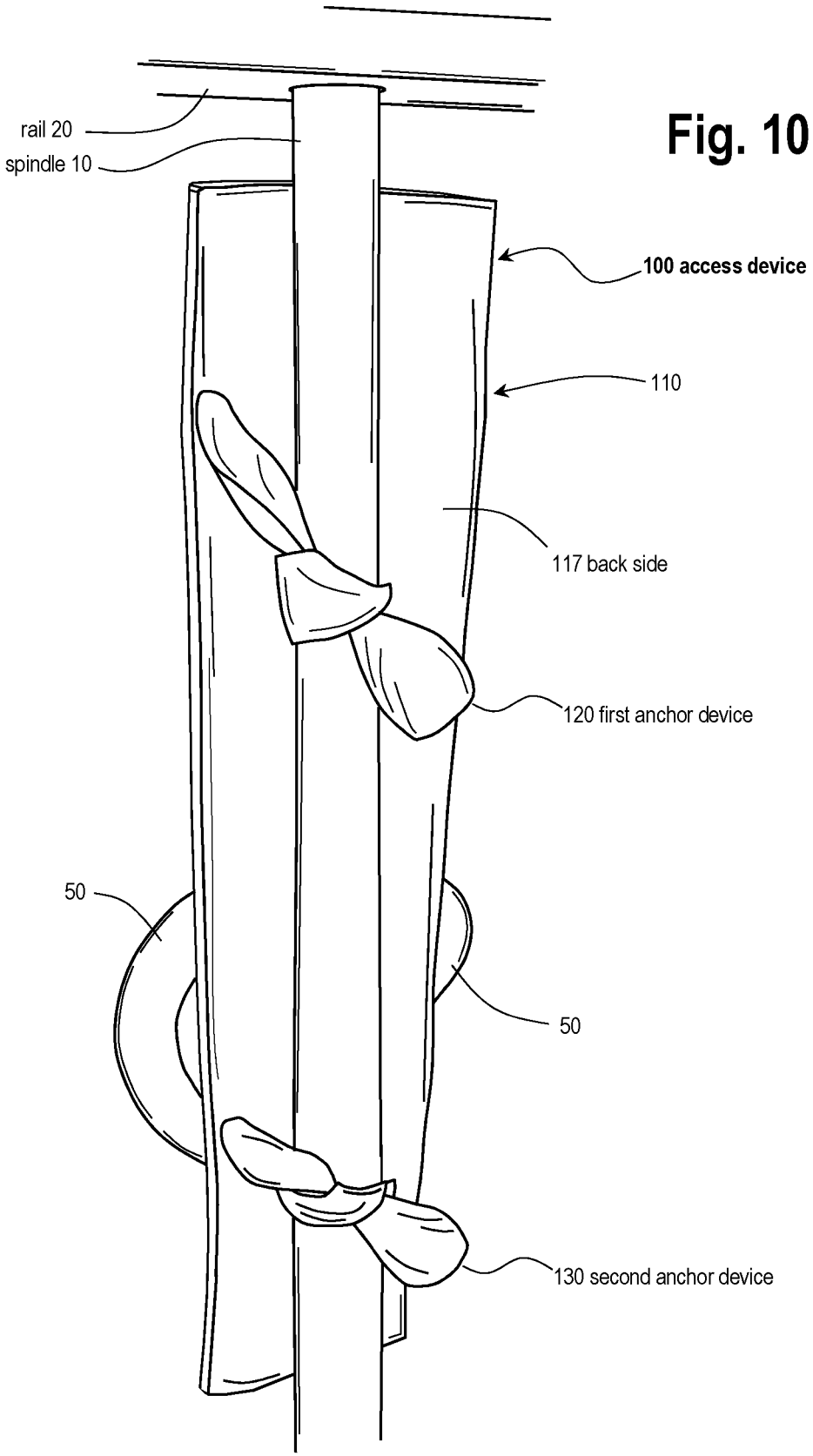
FIG. 10 is a rear view perspective view showing the access device of FIG. 9, with object attached, in accordance with at least one embodiment of the disclosure.

FIG. 9 is a front view perspective view showing an access device 100 with object 50 attached, in accordance with at least one embodiment of the disclosure. FIG. 10 is a rear view perspective view showing the access device 100 of FIG. 10, with object attached, in accordance with at least one embodiment of the disclosure. As shown in FIG. 9 and FIG. 10, the access device 100 is attached to a spindle 10. For example, the spindle 10 might be on the side of a crib. In turn, the spindle 10 can be supported by other structure of the crib, such as rail 20.

As shown in FIG. 9, the device body 110 includes retention device 140, retention device 150, and retention device 160. Each of such retention devices are attached or connected to a front side 116 of the device body 110 of the access device 100. Illustratively, the retention device 150 is shown retaining an infant device 50 by wrapping around the infant device 50. An infant may remove the infant device 50 by pulling on the infant device 50.

As shown specifically in FIG. 10, the access device 100 can be attached to the spindle 10 using first anchor device 120 and second anchor device 130. In the embodiment of FIG. 10, such anchor devices 120, 130 are shown as straps. However, it is appreciated that the particular structure of the anchor devices can vary as otherwise described herein. For example, the anchor devices 120, 130 can be, or include, straps that are connected to the backside 117, with the ends of such straps being provided with Velcro, i.e. hook and loop fasteners, for example, so as to secure onto the spindle 10.

In accordance with at least one embodiment of the disclosed subject matter, with reference to FIG. 9, the access device 100 can include a retention device 140, 150. Each retention device can include a strap that is secured onto the device body; a first mechanical fastener attached to the strap; and a second mechanical fastener attached to a distal, ventral portion of the strap, to an end of the strap, or to some other area or portion of the strap. The first mechanical fastener can be configured to be attached to the second mechanical fastener so as to removably retain an object.

With regard to a retention device, a first mechanical fastener can be a layer of loop fasteners, and a second mechanical fastener can be a layer of hook fasteners. The layer of loop fasteners can be engageable with the layer of hook fasteners so as to provide a superior margin, or other area, that can be engageable with an object. The object can be a pacifier, for example.

Figure 11:
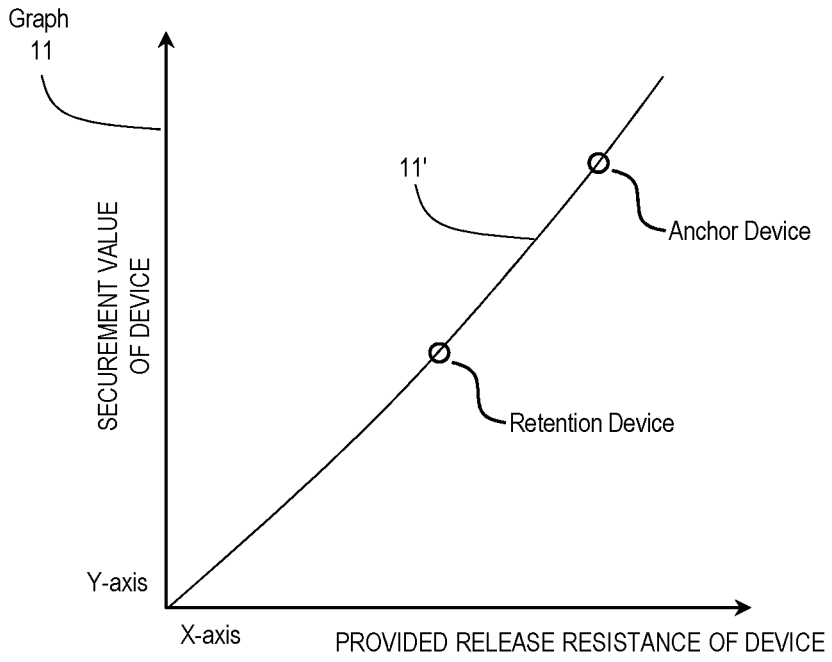
FIG. 11 is a graph with plot, in accordance with at least one embodiment of the disclosure.

FIG. 11 is a graph 11 with plot 11', in accordance with aspects of the disclosure. The x-axis of the graph 11 is "provided release resistance of device". Such value might be characterized as the force required to release a particular object, such as a pacifier, from a retention device of the disclosure. In typical operation, such force might be applied by an infant pulling at an object. On the other hand, the y-axis is a securement value of the device. Such is a value or attribute that can be associated with either an anchor device or a retention device. As the securement value of a particular device (y-axis) increases the force needed to remove an object (x-axis), such as a pacifier, from the access device 100 increases. As illustrated in graph 11, a retention device (or what might also be characterized as a securement device), by construct of the retention device, has a lower securement value than the anchor device. Hand-in-hand, the retention device has a lower release resistance (x-axis) than the anchor device.

In particular, graph 11 is provided to show that the release resistance of the retention device can be less then the release resistance of an anchor device. As a result, an object held by the access device, such as by a pulling force, can be removed from the access device before the access device is removed from the supporting structure. As otherwise described herein, this relationship can be provided by the construct of the retention devices vis-à-vis the anchor devices.

Additionally, this relationship can be provided by the number of retention devices and/or anchor devices, as well as the particular configuration of the retention devices and/or anchor devices. The release resistance of a retention device can be varied by the particular orientation of the retention device relative to the likely angle of pull by an infant. For example, as described above, the retention device can include a folded-over piece of fabric, which is connected to the front side of the device body. The folded over piece of fabric can include fasteners on each end or leg. The fasteners can engage with each other so as to retain an object in the fold that is formed. The particular angle of the strap can be varied so as to adjust the release resistance provided by the device. For example, if the fasteners are positioned at a bottom position, as the strap is oriented, a greater force may be required to remove an object, such as a pacifier, then if the fasteners are positioned at a top position. Such dynamic can be a result of a "sheer" force being applied to the fasteners (which lends to easier removal of the object) versus more of a pure pulling force (which lends itself to more difficult removal of the object). Relatedly, it is appreciated that the retention device need not necessarily be in a vertical or horizontal orientation. Rather, the retention device can be at another desired angle. As the angle is varied, the difficulty of removal of an object (such as a pacifier) can effectively be varied.

Figure 12:
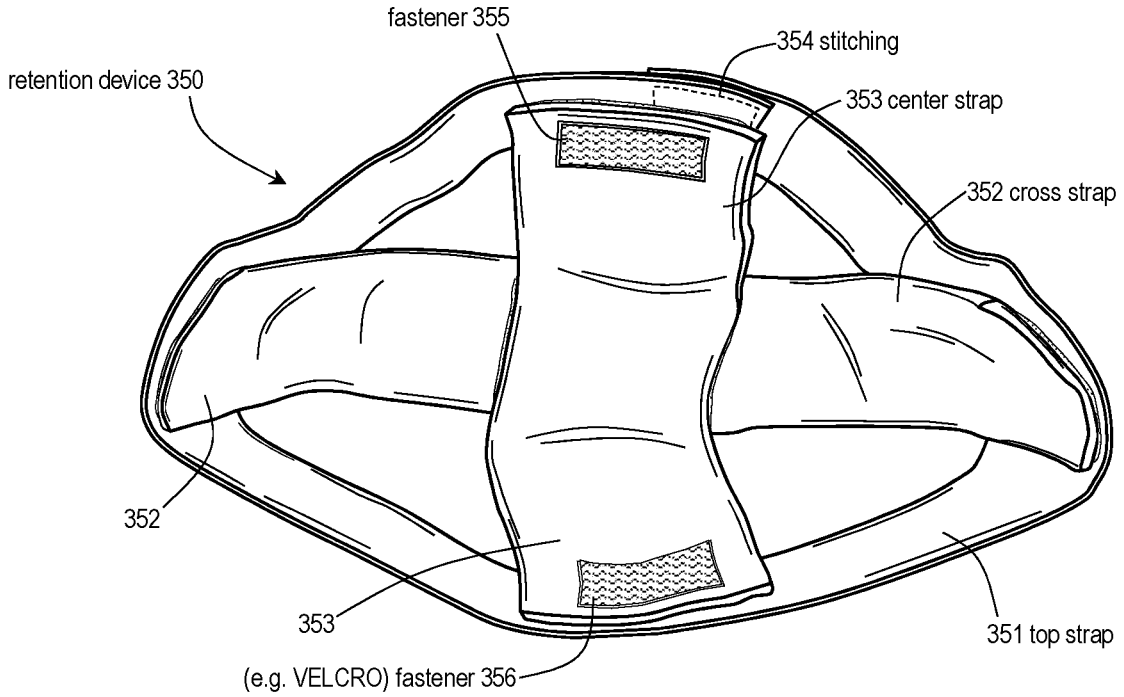
FIG. 12 is a perspective view showing an access device in accordance with a further embodiment of the invention.

FIG. 12 is a perspective view showing an access device, and in particular a retention device 350 of an access device, in accordance with a further embodiment of the invention. One or more retention devices 350, of the structure shown in FIG. 12, can be utilized in conjunction with or in lieu of the retention devices shown in FIG. 1, for example.

The retention device 350 can include a top strap 351 with ends. The top strap 351 can encircle the retention device 350 and be connected at the ends by stitching 354, for example. The top strap can be connected front to back with a center strap 353. Opposing ends of the center strap 353 can include or be attached to fasteners 355, 356. Additionally, the retention device 350 can include cross strap 352. The cross strap 352 can run across the retention device 350. Collectively, the components of retention device 350 can support a variety of objects. The objects can be secured in place utilizing fasteners 355, 356. The retention device 350 can be combined with other types of retention devices so as to be able to hold various items of various shapes. The particular type of Velcro used in the fasteners 355, 356 can determine the amount of force needed to pull an object or item out of the retention device 350. The different components of the retention device 350 can be connected together utilizing mechanical fasteners such as threads, stitching, snaps, adhesive, or other mechanical fasteners, for example.

The retention device 350 can be attached to a device body, of an access device, by stitching, for example.

Figure 13:
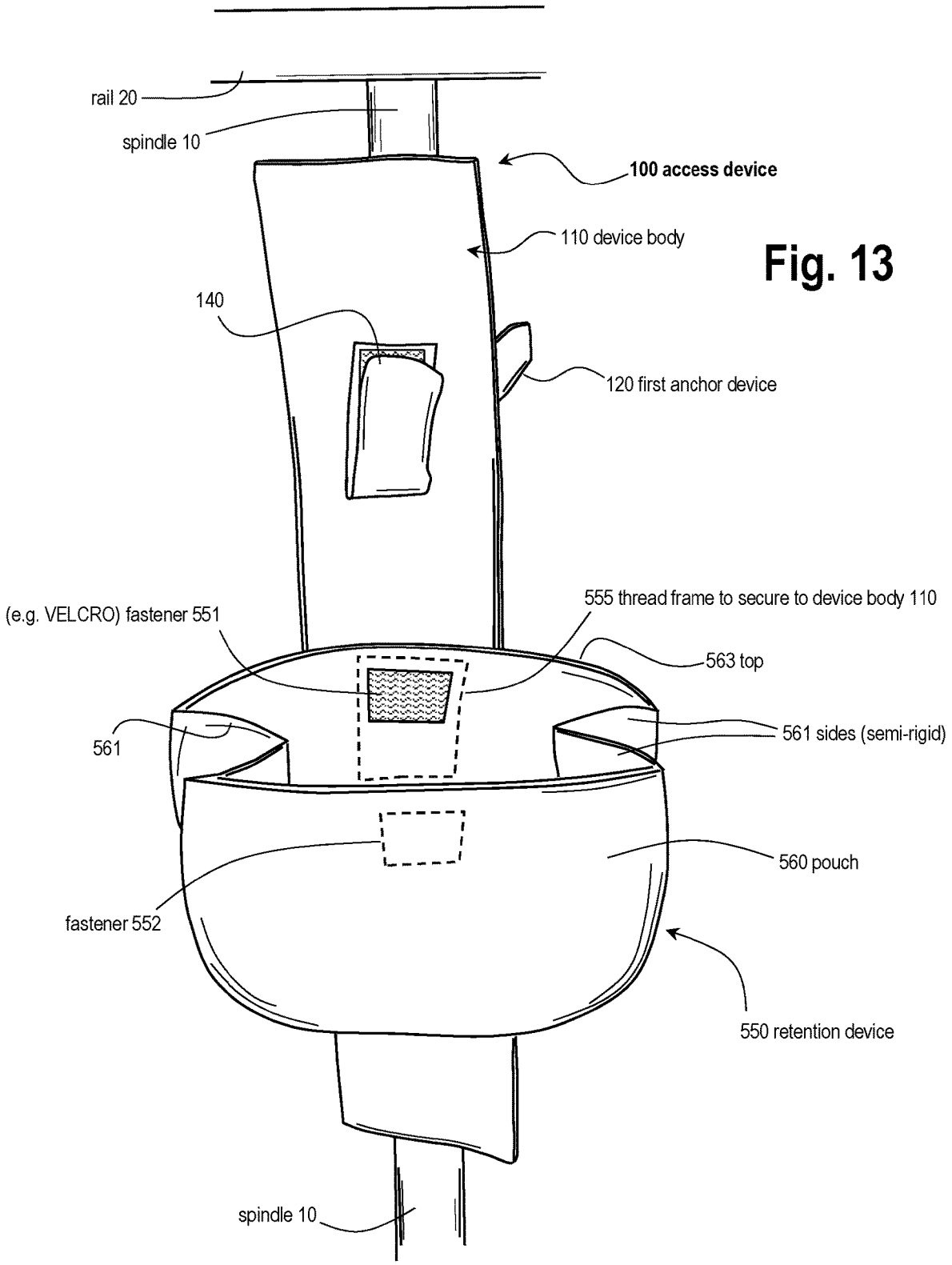
FIG. 13 is a perspective view showing an access device in accordance with a yet further embodiment of the invention.

FIG. 13 shows a further embodiment of an access device 100, in accordance with at least one embodiment of the disclosure.

As shown in FIG. 13, the retention device 550 in this further embodiment includes a pouch 560. The pouch 560 can include a front, a back, and sides 561. The sides 561 can be semi-rigid. The semi-rigid construct of the sides 561 can possess a certain "memory" so that the sides are biased to a particular position. For example, the sides 561 can be biased towards a closed position or an open position. The retention device 550 can include fasteners 551, 552. Such fasteners can be Velcro, for example. The fasteners 551, 552 can secure together so as to retain an object within the pouch 560. In operation, an infant can pull at the top 563 of the pouch so as to access an item held by the pouch 560. The pouch 560 can be secured upon a device body 110 utilizing a thread frame 555, for example. Other attachment arrangement or other threaded arrangement can be used instead of the thread frame 555 to attach pouch 560 upon a device body 110.

As described herein, it is appreciated that various materials can be utilized for the device body, the anchor devices, and the retention devices. For example, the anchor devices can be constructed of material so as to be conducive to securement to a spindle of a crib or crib slats. Cloth or textile material can be utilized in construction of the access device. Additionally, plastic material can be utilized. Stretchable material can be utilized so as to more readily adapt to different supporting structures.

Various attachment mechanisms can be utilized in the invention. Such attachment mechanisms can include Velcro (hook and loop fasteners), snaps, ties, catches, hooks, or any other attachment mechanism, as may be desired.

The shape of the different components of the access device can also vary. As described above, and shown in the figures, components of the access device 100 can be in a rectangular shape. However, such is illustrative and not limiting. The various components of the access device could be square. The various components of the access device could be irregular shaped and/or tapered and/or of other shape.

The spacing and position of the anchor devices and the retention devices as described herein are illustrative. It should be appreciated that the spacing and position of such devices can be varied depending on the intended implementation of the access device, the particular objects intended to be retained by the access device, as well as other parameters. In accordance with one aspect, the retention devices may be spaced evenly upon the device body. The retention devices may be spaced evenly and/or a sufficient distance apart such that retained or supported objects attached to the access device do not touch or in other manner interfere with each other, as may be desired.

As described above, the access device can include anchor devices so as to support the access device on a supporting structure, such as a crib. One or more additional anchor devices can be provided to further support the access device. In particular, an additional anchor device may be desired to support the access device upon a spindle of a crib. Additionally, the anchor devices and/or the retention devices can be positioned in a different configuration as described above. In particular, the anchor devices and/or retention devices can be configured differently than the vertical aligned arrangement as described above. The anchor devices and/or retention devices can be out-of-line vertically. The anchor devices and/or retention devices can be provided in the form of a triangle with 2 of such devices provided at a first location of the device body and another of such devices provided at another location of the device body.

As otherwise described herein, it is appreciated that a variety of materials can be used to construct the various components of the access device. Various different fabric options can be provided. Fabrics used in the access device can vary in various ways. Fabrics can be used of different thickness, coarseness, and stiffness, for example. Any of the components of the access device can be varied in feel and touch depending on the particular environment of intended use. For example, an access device for very young children might be of different stiffness, coarseness, texture, or other attribute—as compared to an access device for older children or toddlers, for example. The color of any component of the access device can be varied as desired. Any component of the access device can be constructed of glow-in-the-dark material as may be desired.

It is appreciated that the various components of embodiments of the disclosure may be made from any of a variety of materials including, for example, plastic, plastic resin, nylon, composite material, foam, rubber, wood, metal, leather and/or ceramic, for example, or any other material as may be desired. For example, the device(s) of this disclosure may be produced using a plastic resin, such as polyethylene, and be injection molded A variety of production techniques may be used to make the apparatuses as described herein. For example, suitable textile fabrication, suitable injection molding and other molding techniques and other manufacturing techniques might be utilized. Also, the various components of the apparatuses may be integrally formed, as may be desired, in particular when using molding construction techniques. Also, the various components of the apparatuses may be formed in pieces and connected together in some manner, such as with suitable adhesive and/or heat bonding or by other attachment technique.

The various apparatuses and components of the apparatuses, as described herein, may be provided in various sizes and/or dimensions, as desired.

It will be appreciated that features, elements and/or characteristics described with respect to one embodiment of the disclosure may be variously used with other embodiments of the disclosure as may be desired.

It will be appreciated that the effects of the present disclosure are not limited to the above-mentioned effects, and other effects, which are not mentioned herein, will be apparent to those in the art from the disclosure and accompanying claims.

Although the preferred embodiments of the present disclosure have been disclosed for illustrative purposes, those skilled in the art will appreciate that various modifications, additions and substitutions are possible, without departing from the scope and spirit of the disclosure and accompanying claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present.

It will be understood that when an element or layer is referred to as being "onto" another element or layer, the element or layer can be directly on another element or layer or intervening elements or layers. Examples include "attached onto", secured onto", and "provided onto". In contrast, when an element is referred to as being "directly onto" another element or layer, there are no intervening elements or layers present. As used herein, "onto" and "on to" have been used interchangeably.

It will be understood that when an element or layer is referred to as being "attached to" another element or layer, the element or layer can be directly attached to another element or layer or intervening elements or layers. In contrast, when an element is referred to as being "attached directly to" another element or layer, there are no intervening elements or layers present. It will be understood that such relationship also is to be understood with regard to: "secured to" versus "secured directly to"; "provided to" versus "provided directly to"; and similar language.

As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present disclosure.

Spatially relative terms, such as "lower", "upper", "top", "bottom", "left", "right" and the like, may be used herein for ease of description to describe the relationship of one element or feature to another element(s) or feature(s) as illustrated in the drawing figures. It will be understood that spatially relative terms are intended to encompass different orientations of structures in use or operation, in addition to the orientation depicted in the drawing figures. For example, if a device in the drawing figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein should be interpreted accordingly.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "including", "comprises" and/or "comprising," and variations thereof, for example, when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to diagrams and/or cross-section illustrations, for example, that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of components illustrated herein but are to include deviations in shapes that result, for example, from manufacturing or fabrication.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, as otherwise noted herein, when a particular feature, structure, or characteristic is described in connection with any embodiment, it is submitted that it is within the purview of one skilled in the art to effect and/or use such feature, structure, or characteristic in connection with other ones of the embodiments.

Embodiments are also intended to include or otherwise cover methods of using and methods of manufacturing any or all of the elements disclosed above.

While the subject matter has been described in detail with reference to exemplary embodiments thereof, it will be apparent to one skilled in the art that various changes can be made, and equivalents employed, without departing from the scope of the disclosure.

All related art references discussed herein are hereby incorporated by reference in their entirety. All documents referenced herein are hereby incorporated by reference in their entirety.

In conclusion, it will be understood by those persons skilled in the art that the present disclosure is susceptible to broad utility and application. Many embodiments and adaptations of the present disclosure other than those herein described, as well as many variations, modifications and equivalent arrangements, will be apparent from or reasonably suggested by the present disclosure and foregoing description thereof, without departing from the substance or scope of the disclosure.

Accordingly, while the present disclosure has been described here in detail in relation to its exemplary embodiments, it is to be understood that this disclosure is only illustrative and exemplary of the present disclosure and is made to provide an enabling disclosure of the disclosure. Accordingly, the foregoing disclosure is not intended to be construed or to limit the present disclosure or otherwise to exclude any other such embodiments, adaptations, variations, modifications and equivalent arrangements.

What is claimed is:

1. An access device for removably retaining objects, the access device comprising:

a device body including a back side and a front side;

a first anchor device secured on the back side of the device body, and the first anchor device for securing the access device to a supporting structure;

the first anchor device including a first side and a second side, the first anchor device constructed of material attached to the device body proximate a middle portion of the first anchor device, such that (a) the first side, of the first anchor device, is positioned on a first side of the device body; and (b) the second side, of the first anchor device, is positioned on a second side of the device body, so that the first side, of the first anchor device, is configured to attach to the second side, of the first anchor device, so as to attach to the supporting structure;

a second anchor device secured on the back side of the device body, and the second anchor device also for securing the access device to the supporting structure, and the first anchor device and the second anchor device providing a plurality of anchor assemblies, and the plurality of anchor assemblies serve to secure the access device to the supporting structure;

the second anchor device including a third side and a fourth side, the second anchor device constructed of further material attached to the device body proximate a middle portion of the second anchor device, such that (a) the third side, of the second anchor device, is positioned on the first side of the device body; and (b) the fourth side, of the second anchor device, is positioned on the second side of the device body, so that the third side is configured to attach to the fourth side so as to attach to the supporting structure;

a first retention device secured on the front side of the device body, and the first retention device for removably retaining a first object, of the objects; and a second retention device secured on the front side of the device body, and the second retention device for removably retaining a second object, of the objects.

2. The access device of claim 1, wherein the device body includes a double layer of textile material to provide stiff construct of the device body.

3. The access device of claim 1, wherein the first retention device and the second retention device are constructed of respective pieces of a textile material.

4. The access device of claim 1, wherein the first retention device includes:

a strap that is secured onto the device body;

a first mechanical fastener attached to the strap; and a second mechanical fastener attached to a distal, ventral portion of the strap, and wherein the first mechanical fastener is configured to be attached to the second mechanical fastener so as to removably retain the object.

5. The access device of claim 4, wherein the first mechanical fastener is a layer of loop fasteners, and the second mechanical fastener is a layer of hook fasteners, and the layer of loop fasteners is engageable with the layer of hook fasteners, so that the first retention device is engageable with the object so as to hold the object.

6. The access device of claim 1, wherein:

the plurality of anchor assemblies, collectively, provide a first release resistance that is resistance required to remove the anchor device from the supporting structure;

the first retention device provides a second release resistance that is resistance required to remove the object from the access device; and wherein the first release resistance is greater than the second release resistance.

7. The access device of claim 1, wherein the access device is constructed to releasably secure a pacifier, and the object is the pacifier.

8. The access device of claim 1, the material and the further material are the same material and the material and the further material include cloth.

9. The access device of claim 1, the first anchor device, including the first side, and the second side, is the same construct as the second anchor device, including the third side and the fourth side.

10. The access device of claim 1, the first side, of the first anchor device, is configured to tie to the second side, of the first anchor device; and the third side, of the second anchor device, is configured to tie to the fourth side, of the second anchor device.

11. The access device of claim 10, the first side, of the first anchor device, is longer than the second side, of the first anchor device, to assist in tying the first anchor device to the supporting structure; and the third side, of the second anchor device, is longer than the fourth side, of the second anchor device, to assist in tying the second anchor device to the supporting structure.

12. The access device of claim 1, the first side, of the first anchor device, is configured to attach, via hook-and-loop fastener, to the second side, of the first anchor device; and the third side, of the second anchor device, is configured to attach, via hook-and-loop fastener, to the fourth side, of the second anchor device.

13. The access device of claim 1, the first anchor device is above the second anchor device;

at least a portion of the first retention device is above the first anchor device; and at least a portion of the second retention device is below the second anchor device.

14. The access device of claim 13, further including a third retention device that is positioned between the first retention device and the second retention device.

15. The access device of claim 13, the access device configured to be attached to a vertical spindle of a crib, the vertical spindle of the crib being the supporting structure.

* * * * *